US012312784B2

(12) United States Patent
Schlueter

(10) Patent No.: US 12,312,784 B2
(45) Date of Patent: May 27, 2025

(54) KITCHEN WATER FAUCET SPRAY HEAD

(71) Applicant: Grohe AG, Hemer (DE)

(72) Inventor: Matthias Schlueter, Dortmund (DE)

(73) Assignee: GROHE AG, Hemer (DE)

( * ) Notice: Subject to any disclaimer, the term of this patent is extended or adjusted under 35 U.S.C. 154(b) by 0 days.

(21) Appl. No.: 18/029,834

(22) PCT Filed: Mar. 8, 2022

(86) PCT No.: PCT/EP2022/055920

§ 371 (c)(1),
(2) Date: Mar. 31, 2023

(87) PCT Pub. No.: WO2022/189443

PCT Pub. Date: Sep. 15, 2022

(65) Prior Publication Data

US 2023/0366179 A1 Nov. 16, 2023

(30) Foreign Application Priority Data

Mar. 12, 2021 (DE) ..... 10 2021 106 082.6

(51) Int. Cl.
*E03C 1/04* (2006.01)

(52) U.S. Cl.
CPC .... *E03C 1/0405* (2013.01); *E03C 2001/0415* (2013.01)

(58) Field of Classification Search
CPC ..... E03C 1/0405; E03C 2001/0415
USPC ..... 4/678
See application file for complete search history.

(56) References Cited

U.S. PATENT DOCUMENTS

| | | | | |
|---|---|---|---|---|
| 7,494,074 | B2 * | 2/2009 | Benstead | E03C 1/084 239/447 |
| 9,707,572 | B2 | 7/2017 | Erickson et al. | |
| 10,130,959 | B1 | 11/2018 | Xiao et al. | |
| 12,006,671 | B2 * | 6/2024 | Macsay | E03C 1/0405 |
| 2007/0246577 | A1 * | 10/2007 | Leber | B05B 1/18 239/548 |
| 2019/0184409 | A1 | 6/2019 | Wang et al. | |
| 2019/0224694 | A1 * | 7/2019 | Wang | B05B 12/087 |
| 2020/0376504 | A1 * | 12/2020 | Yan | B05B 1/169 |
| 2021/0108398 | A1 * | 4/2021 | Dan | B05B 1/18 |
| 2021/0148101 | A1 * | 5/2021 | Lev | F16K 31/605 |

(Continued)

FOREIGN PATENT DOCUMENTS

CN 106594298 4/2017

OTHER PUBLICATIONS

English translation of International Search Report mailed Jul. 18, 2022 in International (PCT) Application No. PCT/EP2022/055920, pp. 1-2.

*Primary Examiner* — Huyen D Le
(74) *Attorney, Agent, or Firm* — Wenderoth, Lind & Ponack, L.L.P.

(57) ABSTRACT

A spray head (1) for a water faucet (2), comprising:
a flow setting means (3) for setting a water flow rate, and
a spray pattern setting means (4) for setting a spray pattern (5),
wherein the flow setting means (3) can be changed over from a first flow setting (6) for a first flow rate to a second flow setting (7) for a second flow rate increased relative to the first flow rate, wherein the first flow setting (6) is preset and the second flow setting (7) can be selected by an actuation of the flow setting means (3).

8 Claims, 1 Drawing Sheet

(56) References Cited

U.S. PATENT DOCUMENTS

| | | | | |
|---|---|---|---|---|
| 2022/0268002 | A1* | 8/2022 | Wu | E03C 1/0405 |
| 2022/0275611 | A1* | 9/2022 | Wang | E03C 1/0405 |

* cited by examiner

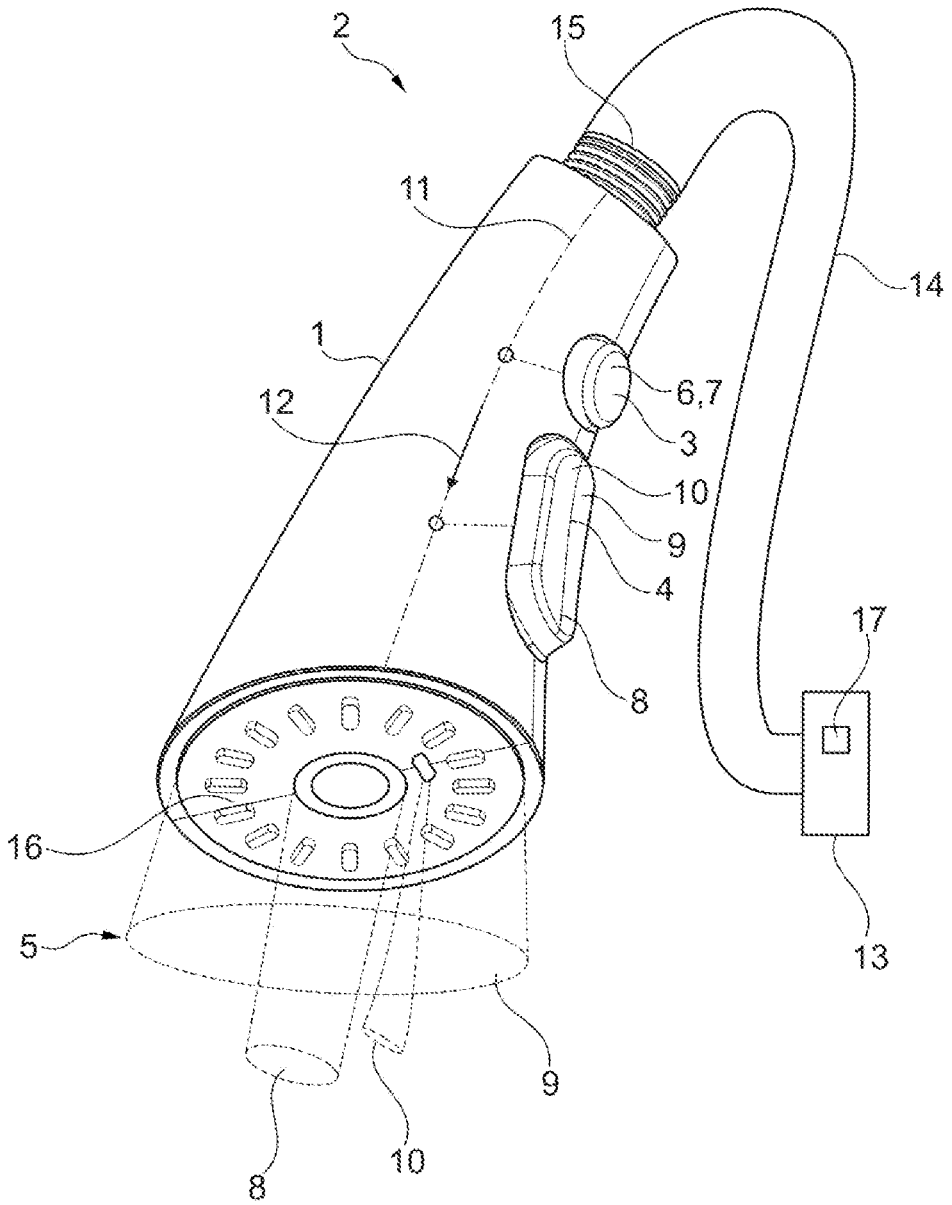
2
15
11
14
1
6,7
12
3
10
9
4
17
8
16
5
13
9
8
10

KITCHEN WATER FAUCET SPRAY HEAD

Below, a water faucet, which is particularly suitable for applications in kitchens, is described. Recently, the hygienic requirements for water faucets have become more and more stringent. Simultaneously, the need arises to be able to provide the user with multiple types of water jets, making different ways of providing water (for instance, different jet hardnesses) available to the user. For instance, a hard jet with high momentum of the water exiting the water faucet can be used to clean dishes, whereas another (gentler) jet can be used to clean vegetables or perform similar tasks.

In addition, in all applications, it is becoming increasingly important to provide an option for conserving water. This is especially true in the field of application of water faucets in the kitchen.

Based thereon, a particularly advantageous new spray head is to be described, which can be used to both select a desired spray pattern and implement water conservation measures in a complementary manner.

These problems are solved by a spray head according to the features of the independent claim. Further advantageous embodiments of the spray head and a particularly advantageous water faucet having such a spray head are specified in the dependent claims, to which, however, the invention is not limited. The invention is further elaborated with reference to the FIGURE and the description relating thereto.

Below, a spray head for a water faucet is described, comprising a flow setting means for setting a water flow rate; and a spray pattern setting means for setting a spray pattern, wherein the flow setting means can be changed over from a first flow setting for a first flow rate to a second flow setting for a second flow rate increased relative to the first flow rate, wherein the first flow setting is preset and the second flow setting can be selected by an actuation of the flow setting means.

The spray head for a water faucet described herein is, in particular, a spray head for a kitchen application. This spray head has both a flow setting means, which can be used to set a water flow rate provided to the user via the spray head, and a spray pattern setting means, which can be used to set a spray pattern of the water provided with the spray head.

The flow setting means is designed such that two predefined flow settings exist or can be selected, namely a first flow setting and a second flow setting. The phrase "flow rate setting for a flow rate" means that at a certain pressurization of the water, at a pressure connection of the shower, exactly one specific flow rate of water, which is provided using the shower, results. Water provided here means the amount of water per unit time provided at the discharge end. However, the flow rate can also be different for a volume setting and a certain applied pressure depending on which spray pattern is set or selected using the spray pattern setting means. In particular, this is caused by the flow resistance for the water being different depending on the spray pattern selected, in particular the flow resistance in the downstream direction of the flow setting means.

It is possible to switch between the two flow rate settings such that the flow rate is set according to the first flow rate setting or according to the second flow rate setting.

An additional setting option for the water flow rate can be provided, for instance on a fixed installation also assigned to the water faucet. Such additional means for setting the water flow rate can, for instance, also enable a continuous/infinitely variable adjustment of the flow rate and, for this purpose, be designed, for instance, as a rotary valve or the like. This, such further means for setting the water flow rate have thus to be distinguished from the flow setting means described herein.

Because the flow setting means can be used to set exactly two different flow settings it is very easy for the user to set the desired water volume using the water faucet described. The simplicity for the user results in particular in comparison with a continuously/infinitely variable setting means, where the user has to make a very conscious decision with regard to the exact amount of water desired and a slight change (a slightly excessive motion or a slightly insufficient motion) can result in very undesirable effects.

The spray head is particularly advantageous when permanent actuation of the flow setting means is required to maintain the second flow setting.

In this preferred embodiment variant, the second quantity setting is preferably increased relative to the first quantity setting. I.e., when the second quantity setting is set, a larger quantity of water is provided. As a result of the second flow setting being maintained only by permanent actuation of the flow setting means, the spray head is operated predominantly at the first flow setting. In this way, the water conservation effect is particularly high.

It is also advantageous if a preselection of the first flow setting of the flow setting means is made automatically each time the spray head is put into operation.

Particularly preferably, the spray head is set up in such a way that a kind of return of the quantity setting towards the first quantity setting occurs with the spray head at each start-up (start of the provision of water) and/or at each shut-down (end of the provision of water). The spray head is started up, for instance, by opening an activation means (which is usually part of a fixed installation assigned to the water faucet). Accordingly, shutdown occurs in particular by closing such an activation means. A momentum occurring as a result of the activation of the water flow or a momentum occurring as a result of water flow deactivation can be used to achieve the return of the flow setting means to the first volume setting.

Furthermore, it is advantageous if a change from a first flow setting to the second flow setting and vice versa is performed by the same type of actuation of the flow setting means.

This method of operating the flow setting means is particularly easy and convenient for a user. Preferably, the user can cycle through the designated quantity settings (first quantity setting and second quantity setting) at the touch of a button. This permits a particularly convenient kind of operation.

Also advantageously, the spray pattern setting means can at least be changed over from the spray pattern settings listed below and back:

first spray pattern setting as a mousseur jet, and second spray pattern setting as a spray jet.

For instance, a mousseur jet can be used to gently clean food (vegetables, for instance).

For this type of water jet, the outflowing water is preferably provided by an outlet, in which the speed of the water is reduced, e.g., by widening the cross-section through which the water can flow and additionally conveying the water through a strainer.

A spray jet is preferably always preselected as the default setting when the spray head is put into operation. In particular, this jet permits renders effectively removing normal dirt possible. At the same time, the risk of damaging something (e.g., a food item or even a kitchen utensil) using this jet is low. This is especially true because the spray is neither very firm nor does it have a high momentum.

Furthermore, it is advantageous if the spray pattern setting means can additionally be changed over to at least the spray pattern setting below:

third spray pattern setting using a blade jet.

A blade jet is preferably a special additional spray pattern setting. A blade jet can be very effective in removing dirt that is hard to dissolve. A blade jet is not suitable for cleaning vegetables. Therefore, it is important that the blade jet can also be deactivated.

Moreover, it is advantageous if the flow setting means is disposed along a flow path of water to an outlet of the spray head upstream of the spray pattern setting means.

The flow setting means is preferably designed in the manner of a valve, which can be used to restrict the flow. In contrast, the spray pattern setting means is preferably designed to selectively deliver the water to different water outlets.

Based on the sequence of flow setting means and spray pattern setting means along the flow direction and flow path described herein, a simpler structure of the flow setting means and spray pattern setting means can be implemented. This is achieved in particular by the upstream flow setting means having an adjustable restrictor, while the spray pattern setting means disposed downstream in the flow path then implements a redirection of the water—in particular to different outlets, namely optionally to a first outlet for a first spray pattern in case of a first spray pattern setting, to a second outlet for a second spray pattern for a second jet pattern setting, or to a third outlet for a third spray pattern for a third spray pattern setting. Irrespective of which spray pattern setting has been selected, the water always passes through the flow setting means designed as an adjustable restrictor. When a first flow setting is set, the restrictor has a first cross-section, when the second flow setting is set, the restrictor has a second cross-section.

A water faucet having a described spray head is also to be described here.

The water faucet is particularly advantageous when the spray head is connected to a fixed installation of the water faucet via a flexible hose.

Preferably, an activation means is also provided at the fixed installation, which can, for instance, be designed as a water tap, which basically can be used to activate the provision of water at the water faucet or at the spray head and also to subsequently deactivate it. Such an activation means can be designed in particular as an infinitely variable valve, e.g., as a rotary valve.

The invention and its technical environment are explained in more detail below with reference to the FIGURE. The FIGURE shows preferred exemplary embodiments, but the invention is not limited to those. It should be noted that the FIGURE and in particular the proportions shown in the FIGURE are only schematic. In the FIGURE, FIG. 1 shows a water faucet with a described spray head.

FIG. 1 shows a water faucet 2, which has a described spray head 1. The spray head 1 has a flow setting means 3, which can be used to set the flow rate of water through the spray head 1. The flow setting means 3 can be used, in particular, to select a first flow setting 6 and a second flow setting 7 as desired. The spray head further has a spray pattern setting means 4, which can be used to set a spray pattern 5 of the water discharged using the spray head 1 at an outlet end 16. The spray pattern setting means 4 can be used to select, in particular, a first spray pattern setting 8, a second spray pattern setting 9, or a third spray pattern setting 10, wherein the spray pattern 5 is different in every spray pattern setting 8,9,10. By way of example, it is shown that the spray pattern 5 at a first spray pattern setting 8 is a mousseur jet. By way of example, it is further shown that the spray pattern 5 in a second spray pattern setting 9 is a rain shower spray (also called a shower jet in embodiment variants) having a plurality of individual jets. By way of example, it is furthermore shown that the spray pattern 5 is a blade jet at a third spray pattern setting 10.

In the preferred embodiment variant shown here, the water faucet 2 not only comprises the spray head 1 but it also has a fixed installation 13. The spray head 1 has a pressure port 15, to which a hose 14 is connected, which connects the fixed installation 13 to the spray head 1. The spray head 1 is supplied with water from the fixed installation 13 via the hose 14. Preferably, the pressure port 15 is disposed on the spray head 1 opposite from the outlet end 16. The fixed installation 13 here also has an activation means 17, which can be used to activate or deactivate a water flow to the shower and which is, for instance, a shut-off means.

LIST OF REFERENCE NUMERALS AND TERMS

1 spray head
2 water faucet
3 flow setting means
4 spray pattern setting means
5 spray pattern
6 first quantity setting
7 second quantity setting
8 first spray pattern setting
9 second spray pattern setting
10 third spray pattern setting
11 flow path
12 direction of flow
13 fixed installation
14 hose
15 pressure port
16 outlet end
17 activation means

The invention claimed is:

1. A kitchen water faucet spray head (1), comprising:

a flow setting means (3) for setting a water flow rate, and a spray pattern setting means (4) for setting a spray pattern (5), wherein the flow setting means (3) can be changed over from a first flow setting (6) for a first flow rate to a second flow setting (7) for a second flow rate increased relative to the first flow rate, wherein the first flow setting (6) is pre-set and the second flow setting (7) can be selected by an actuation of the flow setting means (3), and wherein the spray pattern setting means (4) can be changed among at least three spray pattern settings.

2. The kitchen water faucet spray head (1) according to claim 1, wherein permanent actuation of the flow setting means (3) is required to maintain the second flow setting (7).

3. The kitchen water faucet spray head (1) according to claim 1, wherein a preselection of the first flow rate setting (6) of the flow setting means (3) is performed automatically each time the kitchen water faucet spray head (1) is put into operation.

4. The kitchen water faucet spray head (1) according to claim 1, wherein a change from a first flow setting (6) to the second flow setting (7) and vice versa is affected by a same type of actuation of the flow setting means (3).

5. The kitchen water faucet spray head (1) according to claim 1, wherein the at least three spray pattern settings comprise:

first spray pattern setting (8) as a mousseur spray, second spray pattern setting (9) as a spray jet, and third spray pattern setting (10) as a blade jet.

6. The kitchen water faucet spray head (1) according to claim 1, wherein the flow setting means (3) is disposed upstream of the spray pattern setting means (4) in a flow direction (12) along a flow path (11) of water to an outlet of the kitchen water faucet spray head (1).

7. A kitchen water faucet (2), comprising the kitchen water faucet spray head (1) according to claim 1.

8. The kitchen water faucet (2) according to claim 7, further comprising a flexible hose (14) connecting the kitchen water faucet spray head (1) to a fixed installation (13) of the kitchen water faucet (2).

* * * * *